US005084810A

United States Patent [19]

Huang

[11] Patent Number: 5,084,810

[45] Date of Patent: Jan. 28, 1992

[54] STRUCTURE OF BUILT-UP DESK LAMP

[76] Inventor: Soddy Huang, 2F, No. 6, Alley 9, Lane 77, Hsien Hsing St., Shulin, Taipei Hsien, Taiwan

[21] Appl. No.: 618,560

[22] Filed: Nov. 27, 1990

[51] Int. Cl.[5] ..... F21S 1/12

[52] U.S. Cl. ..... 362/410; 362/414

[58] Field of Search ..... 362/410, 413, 414

[56] References Cited

U.S. PATENT DOCUMENTS 2,918,568 12/1959 Steber ..... 362/410
4,527,225 7/1985 Hartman ..... 362/414 X
4,974,139 11/1990 Chin-Chong ..... 362/410 X

*Primary Examiner*—Allen M. Ostrager
*Attorney, Agent, or Firm*—Lowe, Price, LeBlanc & Becker

[57] ABSTRACT

A built-up desk lamp, comprised of a lamp holder supported on a stand by a supporting frame for holding a lamp bulb, wherein the supporting frame is comprised of a plurality of frame sections flexibly adjusted into a desired length; the stand is comprised of a bottom shell connected with an upper shell for holding a connector, which bottom shell has a plurality of projecting strips respectively fastened in a plurality of retainer plates made on the upper shell and a lug connected to a bolt hole on the upper shell by a screw, which connector has one end inserted in a block on the inside of the upper shell and an opposite end connected to a power supply; the lamp holder is comprised of an upper shade connected with a bottom shade, which bottom shade has a plurality of hooks respectively hooked in a plurality of recesses on the upper shade, permitting the upper shade to be conveniently fixedly secured thereto by screws.

2 Claims, 3 Drawing Sheets

STRUCTURE OF BUILT-UP DESK LAMP

BACKGROUND OF THE INVENTION

A built-up desk lamp, comprised of a lamp holder supported on a stand by a supporting frame for holding a lamp bulb, wherein the supporting frame is comprised of a plurality of frame sections flexibly adjusted into a desired length; the stand is comprised of a bottom shell connected with an upper shell for holding a connector, which bottom shell has a plurality of projecting strips respectively fastened in a plurality of retainer plates made on the upper shell and a lug connected to a bolt hole on the upper shell by a screw, which connector has one end inserted in a block on the inside of the upper shell and an opposite end connected to a power supply; the lamp holder is comprised of an upper shade connected with a bottom shade, which bottom shade has a plurality of hooks respectively hooked in a plurality of recesses on the upper shade, permitting the upper shade to be conveniently fixedly secured thereto by screws.

SUMMARY OF THE INVENTION

The present invention is related to desk lamps, and more particularly to a built-up desk lamp which can be conveniently set up and fixedly adjusted to a desired height.

Conventional desk lamps are generally of fixed type and difficult to assembly. The present invention is intended to provide a desk lamp which can be conveniently set up by a non-skillful person without using any special tools.

According to a first aspect of the present invention, there is provided a built-up desk lamp comprised of a lamp holder supported on a stand by a supporting frame for holding a lamp bulb, wherein the supporting frame is comprised of a plurality of frame sections flexibly adjusted according to desired length.

According to a second aspect of the present invention, there is provided a built-up desk lamp comprised of a lamp holder supported on a stand by a supporting frame for holding a lamp bulb, wherein the stand is comprised of a bottom shell connected with an upper shell for holding a connector, which bottom shell has a plurality of projecting strip respectively fastened in a plurality of retainer plates made on the upper shell and a lug connected to a bolt hole on the upper shell by a screw, which connector has one end inserted in a block on the inside of the upper shell and an opposite end connected to a power supply.

According to a third aspect of the present invention, there is provided a built-up desk lamp comprised of a lamp holder supported on a stand by a supporting frame for holding a lamp bulb, wherein the lamp holder is comprised of an upper shade connected with a bottom shade, which bottom shade has a plurality of hooks respectively hooked in a plurality of recesses on the upper shade, permitting the upper shade to be conveniently fixedly secured thereto by screws.

DETAILED DESCRIPTION OF THE PREFERRED EMBODIMENT

Figure 1:
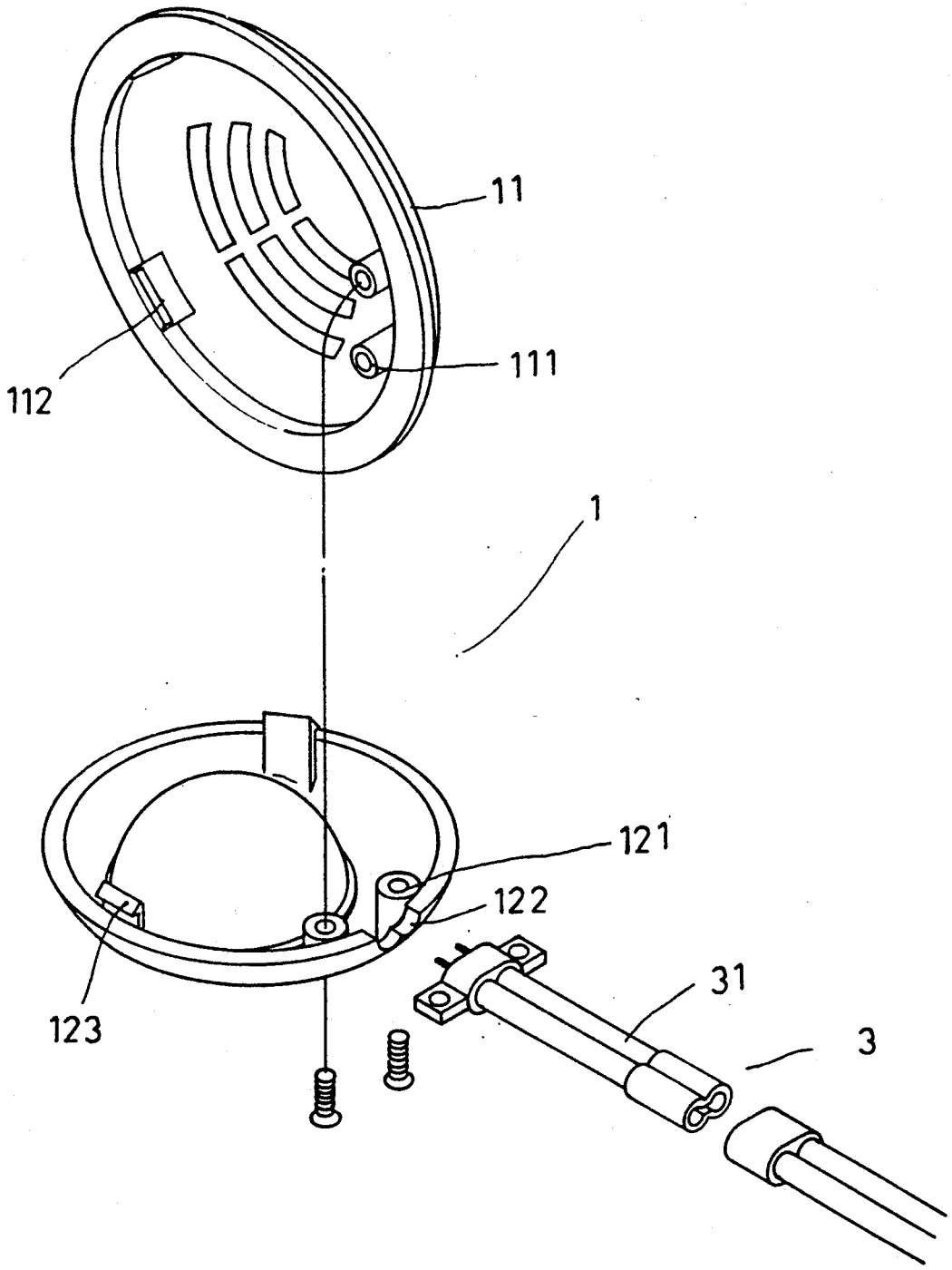
FIG. 1 is a perspective dismantled view of the lamp holder and the lamp support of the preferred embodiment of the present invention.
Figure 2:
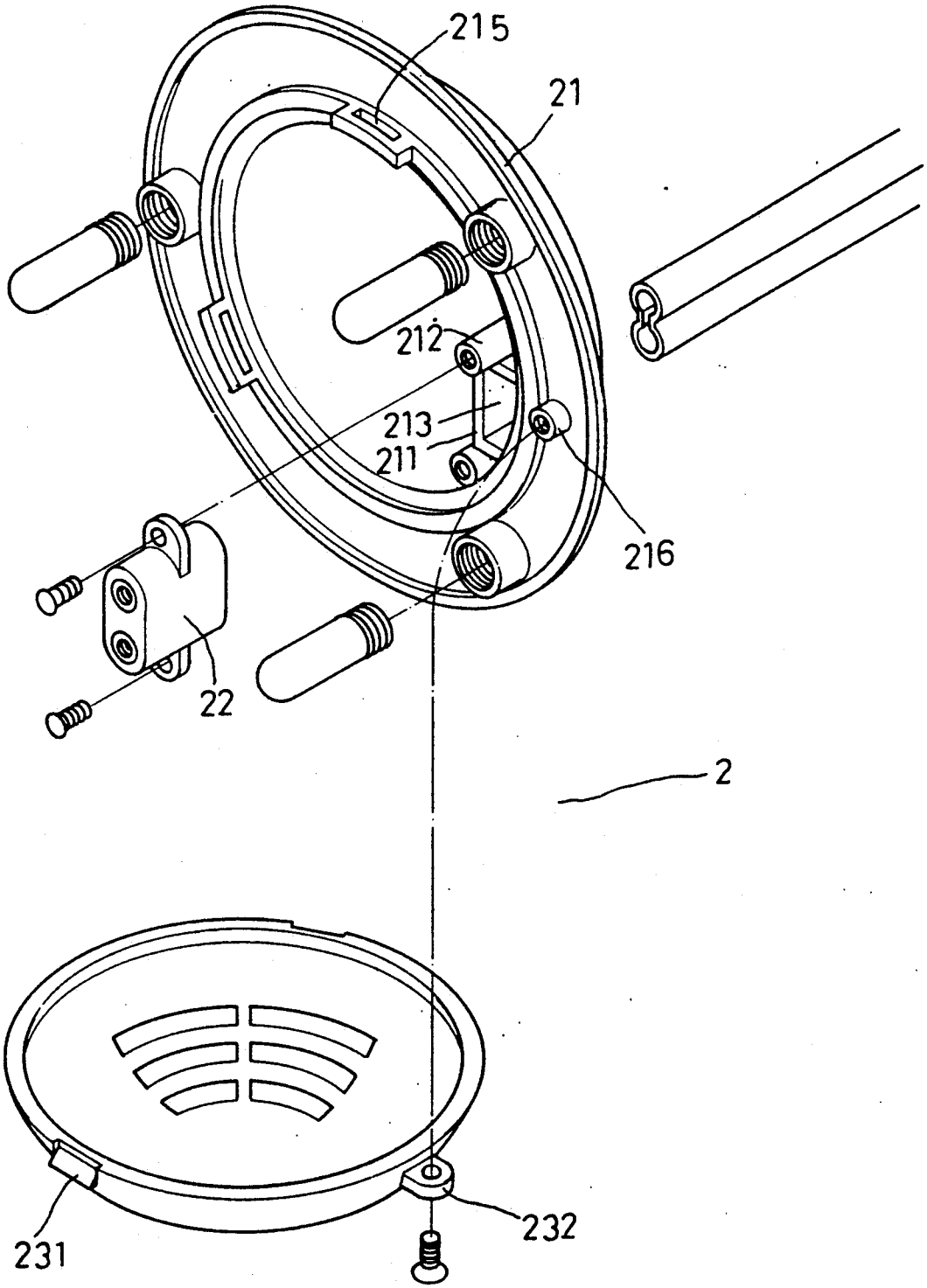
FIG. 2 is a perspective dismantled view of the lamp stand of the preferred embodiment of the present invention.
Figure 3:
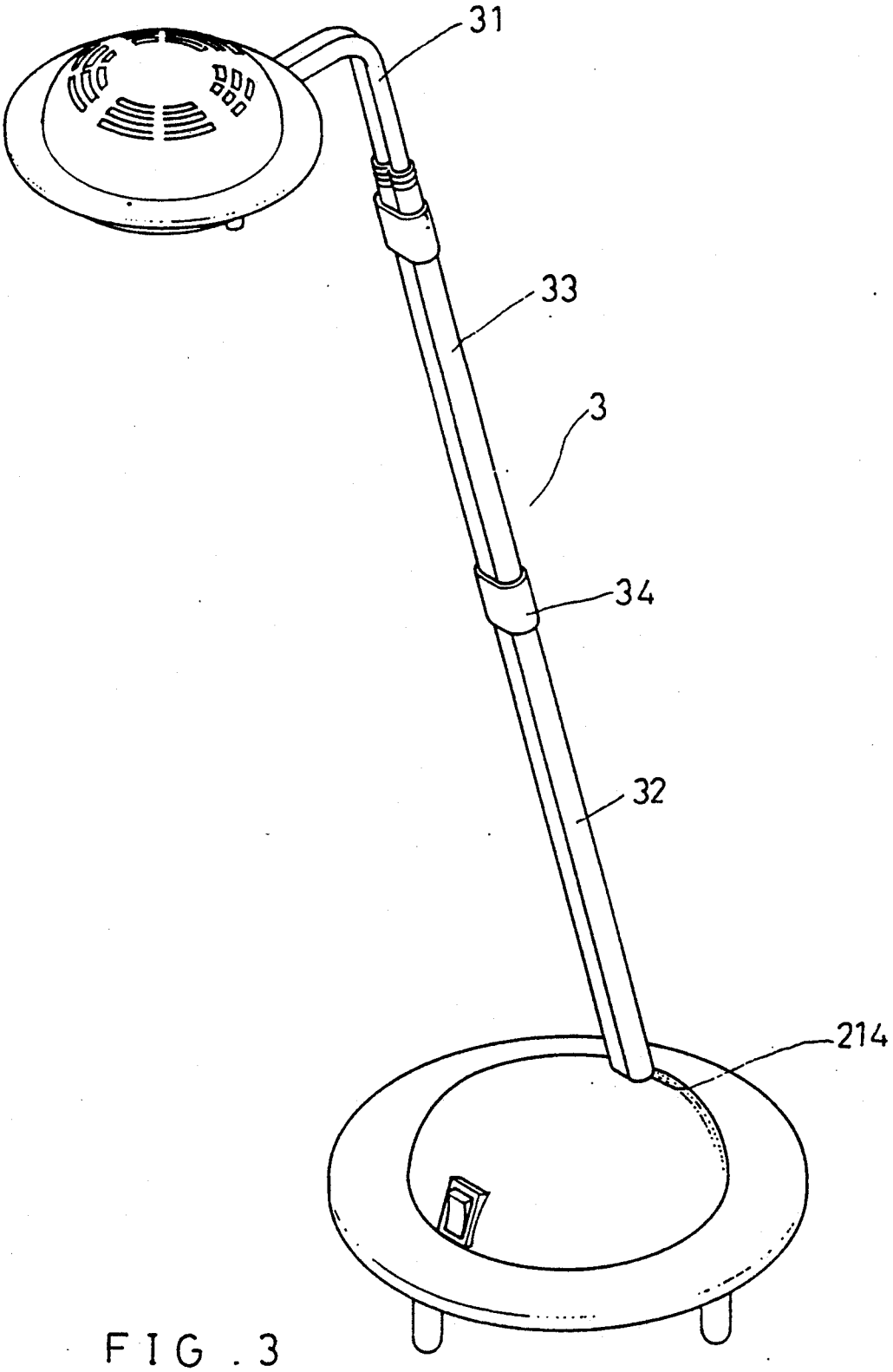
FIG. 3 illustrates the outer appearance of the preferred embodiment of the present invention.

Referring to the annexed drawings in detail, there is illustrated a built-up desk lamp embodying the present invention and generally comprised of a lamp holder 1, a lamp stand 2, and a supporting frame 3.

The lamp holder 1 is comprised of an upper shade 11 and a bottom shade 12. The upper shade 11 has two tubular posts 111, which are internally screw threaded, and a plurality of recesses 112 on the inner edge thereof. The bottom shade 12 has two tubular posts 121, a notch 122 on the edge and a plurality of unitary hooks 123. By hooking the hooks 123 in the recesses 112, the tubular posts 111 are respectively aligned for fastening screws to fixedly secure the bottom shade 12 with the upper shade 11.

The stand 2 is comprised of an upper shell 21, a connector 22 and a bottom shell 23. The upper shell 21 comprises at the inside a free-shaped block 211 defining therein a space 213, two tubular posts 212 which are internally screw threaded, a plurality of retainer plates 215, a bolt hole 216, and at the outside a supporting frame mounting hole 214. The bottom shell 23 comprises a plurality of projecting strips 231 and a lug 232. The connector 22 is fixedly secured to the two tubular posts 212 by screws, having one end inserted in the space 213 of the frame-shaped block 211, and an opposite end provided for connecting to an external power supply. After the connector 22 is fastened in the upper shell 21, the projecting strips 231 of the bottom shell 23 are respectively fastened in the retainer plates 215, permitting the lug 232 to be aligned with the bolt hole 216 for fastening a screw bolt to fixedly secure the upper and bottom shells 21 and 23 together.

The supporting frame 3 is comprised of a plurality of sections connected together through sleeve-joint. In the present preferred embodiment, the supporting frame 3 is comprised of three sections 31, 32 and 33, wherein the upper section of supporting frame 31 has one end fastened in the the notch 112 of the lamp holder 1 and an opposite end secured to the top end of the intermediate section of supporting frame 33 by a bushing 34, the bottom section of supporting frame 32 has one end secured to the bottom end of the intermediate section of supporting frame 33 also by a bushing 34 and an opposite end fastened in the supporting frame mounting hole 214 of the stand 2. The intermediate section of supporting frame 33 may be removed from the supporting frame 3, permitting the upper section of supporting frame 31 to directly connected to the bottom section of supporting frame 32 so as to shorten the height of the desk lamp. As an alternate form, one or more intermediate sections of supporting frame may be connected between the upper and bottom sections of supporting frame to extend the height of the desk lamp.

What is claimed is:

1. A desk lamp comprised of a lamp holder supported on a stand by a supporting frame for holding a lamp bulb, and characterized in that:

said lamp holder is comprised of an upper shade connected with a bottom shade, said upper shade having two tubular posts, which are internally screw threaded, and a plurality of recesses, said bottom shade having two tubular posts connected to the tubular posts on said upper shade for fastening screw bolts, a notch on the edge and a plurality of unitary hooks respectively hooked in the recesses of said upper shade;

said shade is comprised of an upper shell connected with a bottom shell for holding a connector, said upper shell comprising at the inside a frame-shaped block and two tubular posts, which are internally screw threaded, for mounting said connector, a plurality of retainer plates and a bolt hole, and at the outside a supporting frame mounting hole, said bottom shell comprising a plurality of projecting strips respectively fastened in said retainer plates, a lug connected to the bolt hole on said upper shell by a screw bolt; and said supporting frame is comprised of a plurality of frame section connected together through sleeve-joint, having one end fastened in said notch of said lamp holder, and an opposite end fastened in said supporting frame mounting hole of said stand.

2. The desk lamp of claim 1, wherein said supporting frame can be set up with one or more frame sections according to desired length.

* * * * *